US006551031B2

(12) United States Patent
Van Ornum

(10) Patent No.: US 6,551,031 B2
(45) Date of Patent: Apr. 22, 2003

(54) ARTICULATED BARRIER INSERTION ATTACHMENT

(76) Inventor: Leslie Van Ornum, P.O. Box 446, Hortonville, WI (US) 54944

( * ) Notice: Subject to any disclaimer, the term of this patent is extended or adjusted under 35 U.S.C. 154(b) by 0 days.

(21) Appl. No.: 09/895,573

(22) Filed: Jul. 2, 2001

(65) Prior Publication Data

US 2003/0001149 A1 Jan. 2, 2003

(51) Int. Cl.[7] ..... E02F 5/10; E02D 17/20

(52) U.S. Cl. ..... 405/302.7; 405/302.6; 405/15

(58) Field of Search ..... 405/302.6, 302.7, 405/302.4, 258.1, 107, 115, 116, 15, 21, 22; 256/12.5

(56) References Cited

U.S. PATENT DOCUMENTS 3,298,183 A * 1/1967 Grether et al. ..... 405/36
4,705,427 A * 11/1987 Atkins et al. ..... 405/107
5,039,250 A * 8/1991 Janz ..... 405/302.6
5,108,224 A * 4/1992 Cabaniss et al. ..... 405/302.6
5,615,499 A * 4/1997 McGuire et al. ..... 37/367
5,915,878 A * 6/1999 Carpenter ..... 405/270
6,053,665 A * 4/2000 Richardson ..... 405/302.6
6,158,923 A * 12/2000 Wheeler et al. ..... 405/302.6
6,398,459 B1 * 6/2002 Vreeland ..... 405/302.6

* cited by examiner

*Primary Examiner*—Heather Shackelford
*Assistant Examiner*—Frederick Lagman
(74) *Attorney, Agent, or Firm*—Russell L. Johnson, Patent Agent

(57) ABSTRACT

An erosion fence installation attachment for ditchers and trenchers that is short in length and articulated to pivot in pitch and yaw so as to permit the attachment to follow a ditcher through gullies over mounds and around arcs. The attachment is provided with a barrier material roll unwind, a resilient guide that guides the barrier material into a ditch formed by the ditcher so that the barrier material is pressed against the sides and bottom of the ditch to form an open channel, a first ditch fill disk that pushes fill material into the ditch and into the channel formed in the barrier material, a second ditch fill disk that pushes fill material from the opposite side of the ditch and onto and over the barrier material on that side of the ditch to form a wrap around the fill material deposited by the first fill disk so as to form an elongate anchoring pouch filled with fill material along the bottom of the ditch. A stake driven along one side the above ground portion of the barrier material will penetrate at least two layers of the barrier material further securing the anchor in place. To form a barrier fence, the barrier material is secured to the stake by conventional means.

9 Claims, 4 Drawing Sheets

ARTICULATED BARRIER INSERTION ATTACHMENT

BACKGROUND OF THE INVENTION

1. Field of the Invention

This invention relates to barrier fences used to control erosion at construction sites and the like.

More specifically, this invention relates to an apparatus for inserting and anchoring barrier fences.

Still more specifically, this invention relates the apparatus described above wherein the apparatus is in the form of an articulated attachment to a ditcher.

Construction sites and other erosion prone areas of landscape are prime candidates for the insertion of an erosion barrier. Historically, rocks, hay bales, and rooted plants and shrubs have served as erosion barriers. The development of low cost, reinforced, foramanous, plastic film, has made it the material of choice at construction sites where soil is laid bare and where even a benign water course can be severely eroded in a heavy rain.

The foraminous plastic film has numerous small openings through which water can pass, but only slowly. It is in this way that erosion barriers slow the speed of flowing water and thereby greatly reduce erosion.

The installation of a barrier fence typically involves the burying of one long edge of the barrier material in a trench that is transverse to the water course and staking the above ground portion of the barrier material to hold it upright so as to form a barrier to water flow in the water course.

2. Description of Related Art

Erosion barriers having one edge buried in the ground have a number of deficiencies that are cured by the apparatus and methods of this invention.

One vexatious deficiency of barrier fences in use heretofore, is that of pulling out of the ground or falling over when a heavy water load is backed up by the barrier. This problem has its origins in the flow characteristics of wet soil as it takes up water and develops the consistency of mud.

A vexatious problem associated with the installation of barrier fences in use heretofore is that of requiring numerous machines, and/or, machine attachments, and/or significant manual labor to install the barrier fence. Erosion barriers of the type contemplated by this invention can be installed by manual means. The functions of digging a trench, unwinding the barrier material, inserting the barrier material in the trench, filling in the trench and staking the barrier in place are all operations that can and sometimes are performed by hand. The prior art abounds in machines and apparatus that perform the tasks of trenching, unwinding barrier material, positioning barrier material, filling trenches, and staking barriers. None of these prior art devices, alone or in combination can achieve the erosion barrier installation achieved by this invention.

Yet another problem with prior art machines and apparatus for installing erosion barriers is that of length and inflexibility. Erosion barriers typically span a ditch or other undulating contours. Often it is desirable to install an erosion barrier in an arc. The inability of prior art barrier fence installing apparatus to follow contours and/or to follow curvatures due to their length and inflexibility limits the utility of the apparatus.

It is an object of this invention to provide an articulated attachment to a ditcher that can follow the ditcher through undulations and around curves while inserting erosion barrier material in the ditch formed by the ditcher, and anchoring the barrier material while filling the ditch.

It is further an object of this invention to provide the articulated ditcher attachment described above wherein the attachment performs the functions of unwinding erosion barrier material, guiding the material into a trench formed by the ditcher, forming the material into conformance with the bottom and sides of the trench, Partially filling in the trench with filling soil deposited in the barrier material lining the trench, completing the filling of the trench so that the underground portion of the barrier material wraps the soil in the barrier lining the bottom of the treanch.

It is further an object of this invention to provide the attachment described above wherein the underground configuration of the barrier material is such that a stake driven along one side of the above ground portion of the barrier will penetrate at least one layer of the underground portion of the barrier.

It is further an object of this invention to provide the attachment described above wherein the attachment is short in length and easily attached to a ditcher.

Other objects will be made apparent by the following specifications, drawings and claims.

BRIEF SUMMARY OF THE INVENTION

An erosion fence installation attachment for ditchers comprising: an insertion frame joined to a solid structural member of a ditcher by means of a vertical pin and sleeve pivot, a horizontal pivot means connecting the insertion frame to the pin and sleeve pivot and the horizontal pivot is resiliently biased downward, a barrier material roll unwind secured to the insertion frame and carrying a roll of barrier material over said ditch, an insertion guide means which depends from said insertion frame and is positioned to guide the barrier material into a ditch formed by said ditcher and against the sides of said ditch, a ditch bottom following shoe which is a part of said insertion guide means and which is resiliently biased downward and said shoe is positioned below said insertion guide means so as to press barrier material guided by said guide means against the bottom of a ditch formed by said ditcher, a first ditch fill disk secured to said insertion frame and positioned to, in use, cause fill material to be pushed into said ditch and onto the barrier material pressed against said bottom and sides of said ditch, a second ditch fill disk secured to said insertion frame and positioned to, in use, cause fill material to be pushed against said barrier and into said ditch on top of and against said barrier material, and a method for staking and anchoring said erosion fence by means of a stake driven downward along said erosion fence so as to penetrate the barrier material in at least two places.

DETAILED DESCRIPTION OF THE INVENTION

Figure 1:
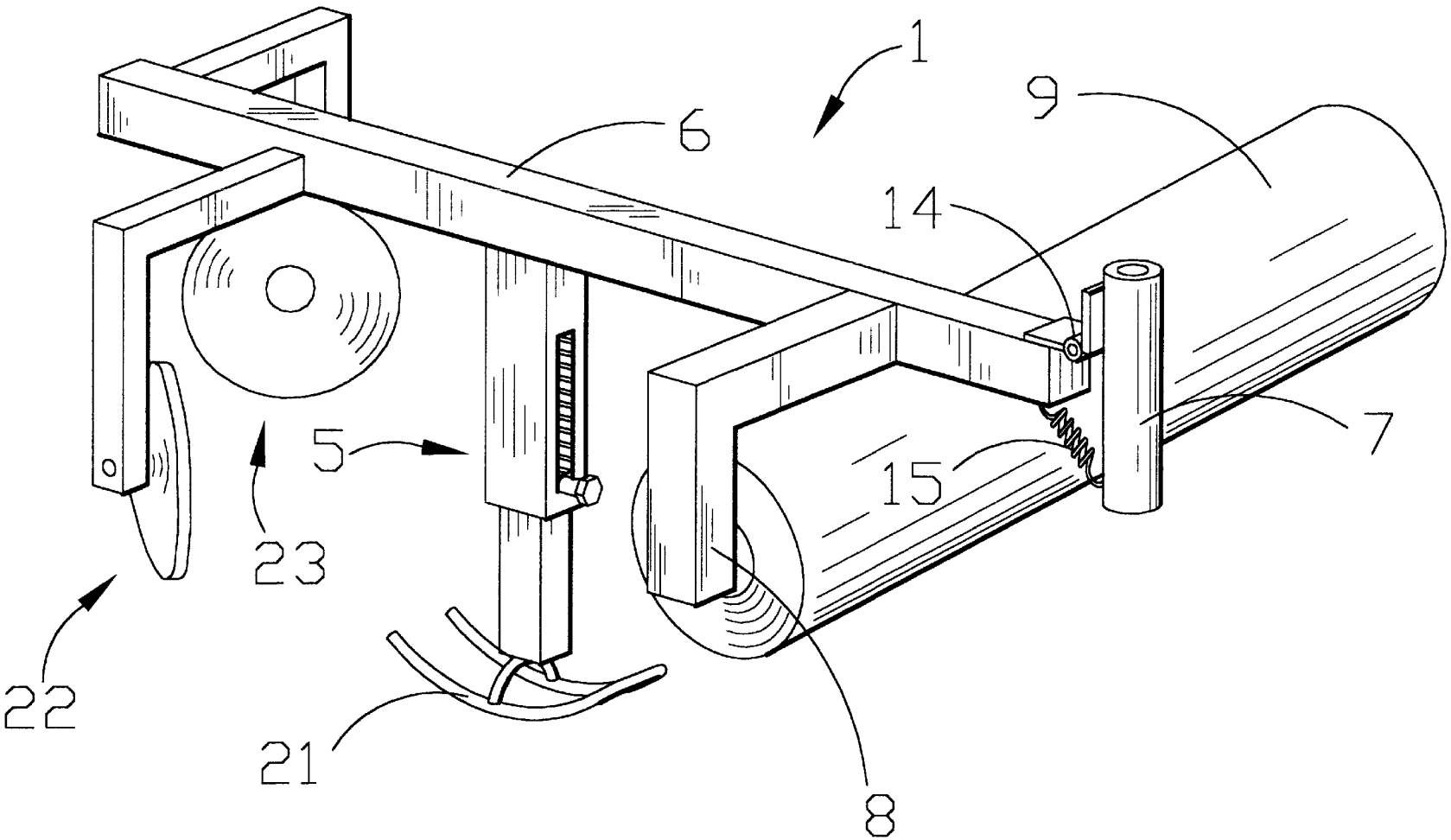
FIG. 1 is a pictorial view of erosion fence installation attachment of this invention.

In the drawings, like numbers refer to like objects and the proportions of some elements have been modified to facilitate illustration. FIGS. 1–7 are schematic in that noncritical detail has been omitted for the sake of clarity of disclosure.

Figure 2:
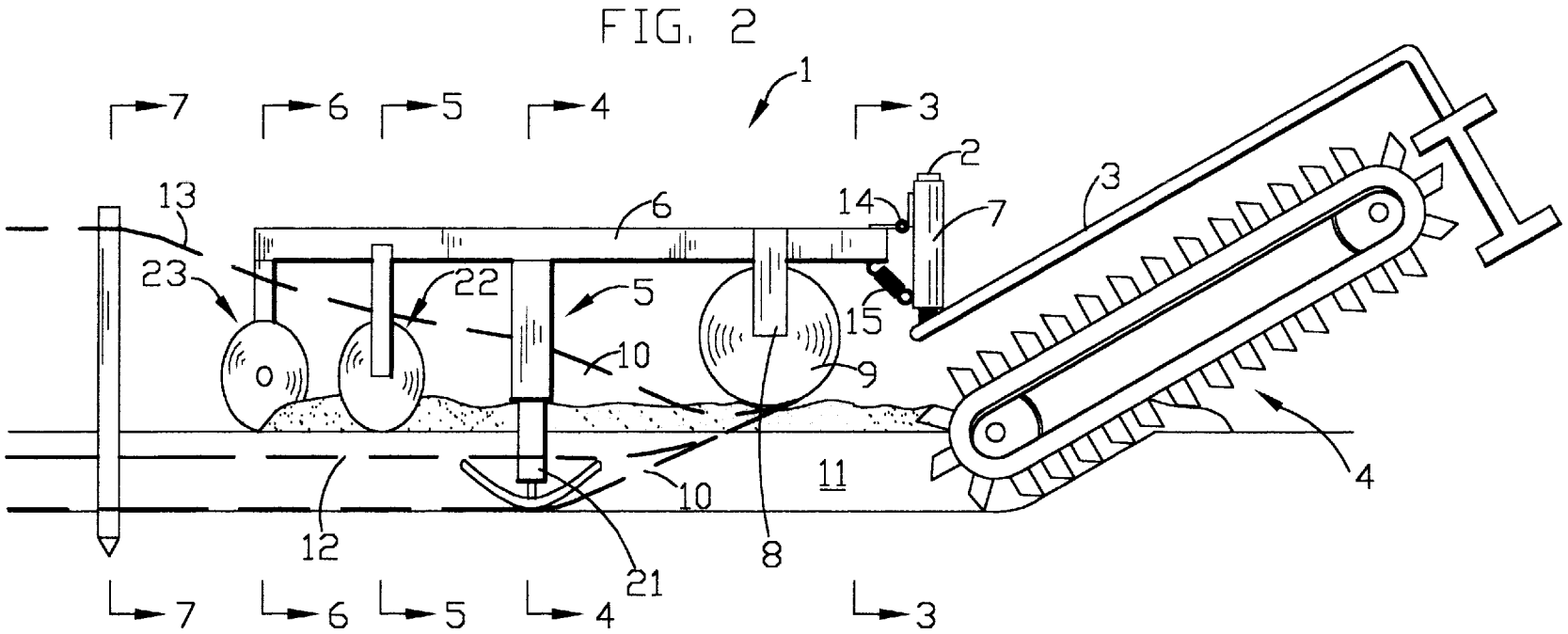
FIG. 2 is an elevational view of attachment of FIG. 1

The erosion fence installation attachment of this invention is to be attached to a part of a ditcher frame that is sturdy. Ditchers typically have a sturdy frame and the attachment of a pivot pin by welding or bolting or the like is readily accomplished. In FIG. 2, pivot pin 2 is shown attached to ditcher frame 3 of ditcher 4.

As shown in FIGS. 1 and 2, erosion fence installation attachment 1 comprises an insertion frame 6 having depending therefrom a barrier material unwind 8, an insertion guide means 5, a first ditch fill disk 22 and a second ditch fill disk 23.

Insertion frame 6 is pivotably joined to ditcher frame 3 by means of sleeve 7 being placed over pin 2 and secured in place thereon. The pivot formed by sleeve 7 rotating on pin 2 permits attachment 1 to move in yaw mode so that attachment 1 can follow ditcher 4 around turns. Insertion frame 6 has secured thereto barrier roll unwind 8 which positions barrier material roll 9 horizontally transverse to the operating line of ditcher 4 so that barrier material 10 (shown in dashed lines in FIG. 2) is positioned over ditch 11 so as to create a short edge 12 and a long edge 13 relative to ditch 11.

Insertion frame 6 is pivotably joined to sleeve 7 by means of transverse horizontal pivot 14 that permits insertion frame 6 to pivot in pitch so as to enable insertion frame 6 to follow ditcher 4 over hills and through gullies. Insertion frame 6 is provided with a resilient downward biasing means 15, hereshown schematically as a coil spring, for the purpose of maintaining the barrier material insertion attachment 1 in contact with ditch 11.

The articulation of ditcher 4 with insertion frame 6 by means of pivot pin 2 and sleeve 7 and the articulation of insertion frame 6 with sleeve 7 by means of horizontal pivot 14 provides the art with a short length articulated erosion fence inserter means capable of following a ditcher around curves and through gullies.

Insertion frame 6 has depending therefrom an insertion guide means 5 having a ditch bottom following shoe 21, a first ditch fill disk 22, and a second ditch fill disk 23.

Figure 3:
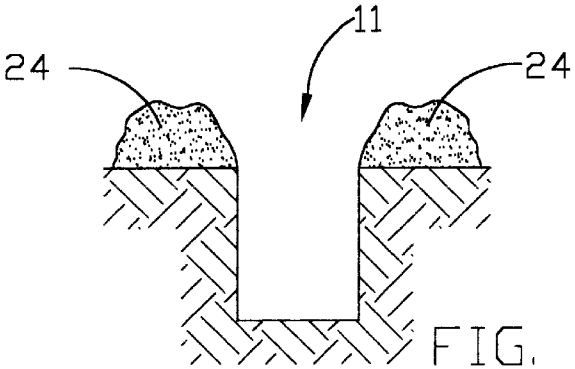
FIG. 3 is a elevational view of a ditch formed by a ditcher to which the attachment of this invention is pivotably joined.

As detailed in FIG. 3, ditcher 4 deposits material on both sides of ditch 11 The material becomes fill material 24 when closing ditch 11 with barrier material 10 positioned therein.

Figure 4:
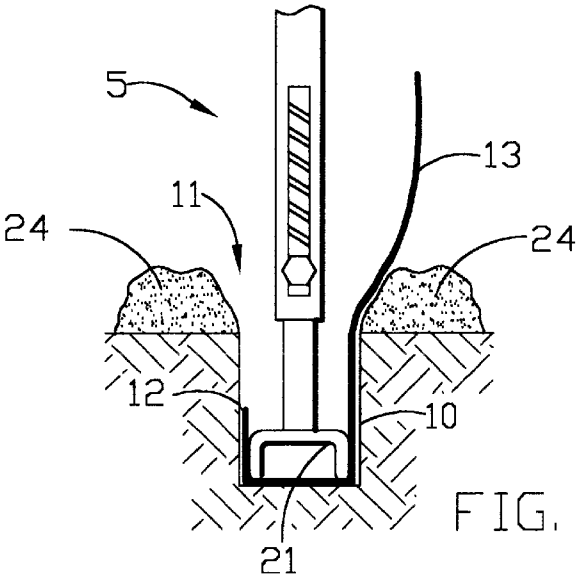
FIG. 4 is an elevational view of the ditch of FIG. 3 showing a guide means positioning barrier material in the ditch.

As detailed in FIG. 4, insertion guide means 5 depends from insertion frame 6 and projects into and along the sides of ditch 11 so that barrier material 10 when passing along insertion guide means 5 is pressed against the sides and along the bottom of ditch 11. Also, as shown in FIG. 4, the positioning of barrier material roll 9 relative to ditch 11 causes the short edge 12 of barrier material 10 to be positioned along the side of ditch 11 and below the top edge of ditch 11 while the long edge 13 of barrier material 10 passes beside insertion guide means 5 to form what will be the above ground portion of an erosion fence. Insertion guide means 5 is configured so as to maintain long edge 13 of barrier material 10 from falling over ditch 11 and possibly interfering with the filling of ditch 11.

Also, as shown in FIGS. 2 and 4, bottom following shoe 21 rests on barrier material 10 and presses it against the bottom of ditch 11 as barrier material 10 passes along guide means 5 creating a channel that lines the bottom of ditch 11.

Figure 5:
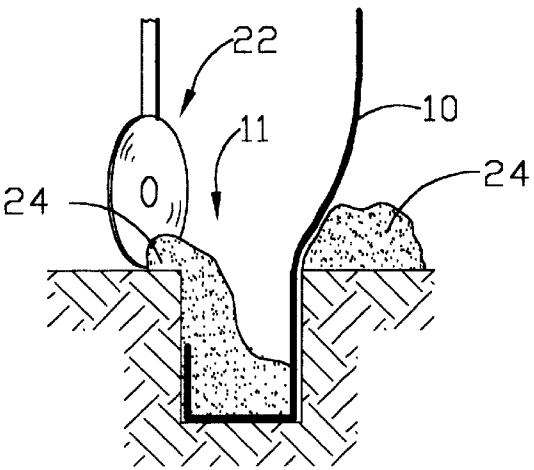
FIG. 5 is an elevational view of the ditch and barrier material of FIG. 4 showing a disk pushing fill material into the ditch and into a channel formed in the barrier material.

As illustrated in FIG. 5, first ditch fill disk 22 serves to push fill material 24 from the side of ditch 11 into the channel in barrier material 10 formed in the bottom of ditch 11 thereby partially filling the channel formed in barrier material 10 with fill material 24.

Figure 6:
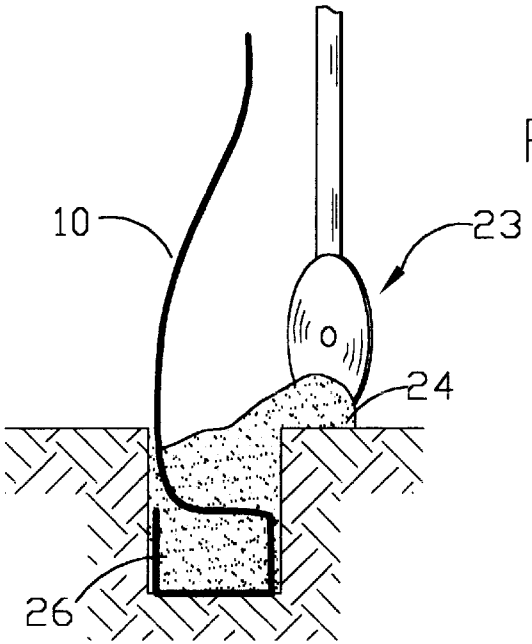
FIG. 6 is an elevational view of the ditch and barrier of FIG. 5 showing a second disk pushing fill material on top of the barrier material to form a long closed pouch of barrier material filled with filled material in the ditch.

As illustrated in FIG. 6, second fill disk 23 closely follows fill disk 22 and serves to push fill material 24 onto barrier material 10 and into ditch 11 so as to cause fill material 24 to flow over barrier material 10 and on top of the fill material 24 deposited by fill disk 22 to create a wrap around the fill material 24 deposited by fill disk 22 creating an anchoring pouch 26 which serves to anchor barrier material 10 in the ground and renders it more difficult to dislodge than prior art erosion fences formed of barrier material 10.

Figure 7:
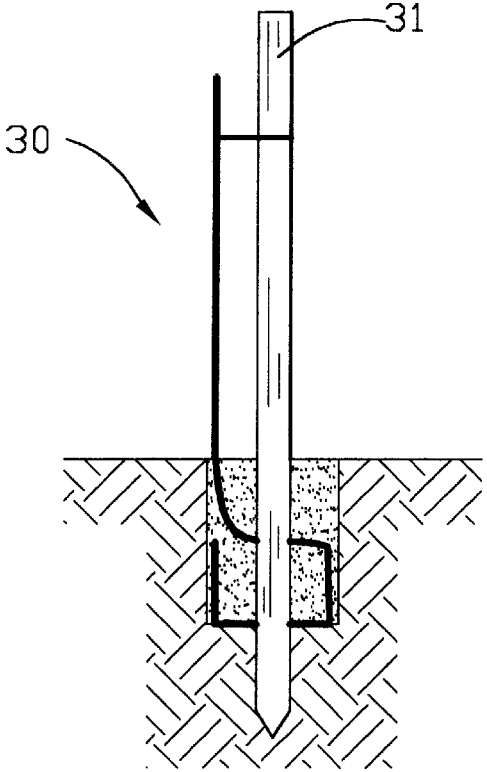
FIG. 7 is an elevational view of the ditch and barrier material configuration of figure 5 showing the preferred method of staking the barrier material in place.

As illustrated in FIG. 7, the completion of erosion fence 30 is achieved by driving support stakes 31 through the portion of barrier material 10 that forms anchoring pouch 26 and securing barrier material 10 to stake 31 by conventional means. The driving of stakes 31 through two of the layers of barrier material 10 that forms anchoring pouch 26 ensures that anchoring pouch 26 will not unwrap and thereby provides an anchor for erosion fence 31 that is more secure than has been heretofore obtainable.

The use of fill disks 22 and 23 in place of the more conventional blades to push fill material 24 into ditch 11 serves to permit the filling means to roll over impediments such as stones and roots and not get caught up on them as has been the case with blades and the like used to push fill material into trenches in the prior art.

The close coupling of the functions of attachment 1 permits the insertion of barrier material 10 into trench 11 over a short distance and when combined with the articulations of attachment 1 and the resilient biasing of the members of attachment 1 enables the insertion of barrier material 10 into trenches 11 that turn more sharply and span deeper ditches than has heretofore been achievable by prior art apparatus.

The above disclosures are enabling and would permit one skilled in the art to make and use the disclosed invention without undue experimentation. However, it should be understood that the scope of the invention is not limited to the scope of the disclosed embodiments, but should only be limited by the scope of the appended claims and all equivalents thereto that would be made obvious thereby to one skilled in the art

What is claimed is:

1. An erosion fence installation attachment for ditchers comprising:

h) an insertion frame pivotable about a vertical axis secured to the structure of a ditch digging ditcher, i) a barrier material roll unwind secured to the insertion frame and carrying a roll of barrier material over said ditch, j) the insertion frame being resiliently articulated about a horizontal axis carried on said insertion frame, k) an insertion guide means which depends from said insertion frame and is positioned to guide the barrier material into a ditch formed by said ditcher and against the sides of said ditch, l) a ditch bottom following shoe resiliently secured to said insertion frame and depending from said insertion frame so as to press said barrier material against the bottom of a ditch formed by said ditcher, m) wherein the insertion guide means comprises a first ditch fill disk secured to said insertion frame and positioned to, in use, cause fill material to be pushed into said ditch and into the barrier material pressed against said bottom and sides of said ditch, n) a second ditch fill disk secured to said insertion frame and positioned to, in use, cause fill material to be pushed against said barrier material and into said ditch on top of and against said barrier material to form a wrap around the fill material deposited by said first ditch fill disk to form an anchoring pouch in said barrier material.

2. The attachment of claim 1 wherein the attachment is pivotally secured to a frame member of said ditcher by means of an upright pivot pin secured to said frame and a pivot sleeve which is a part of said insertion frame so as to enable said attachment to follow said ditcher around curves.

3. The attachment of claim 1 wherein the insertion frame is pivotally secured to pivot sleeve by means of a transverse horizontal hinge so as to enable the insertion frame to follow said ditcher through depressions and over rises and said insertion frame is resiliently biased downward so as to urge the insertion apparatus downward into a ditch formed by said ditcher.

4. The attachment of claim 1 wherein the barrier roll unwind of claim 1 positions a roll of barrier material horizontally over and transverse to a ditch created by said ditcher and the roll is positioned over the ditch so that the center of said roll is not over the center of said ditch and thereby creates a long edge of said barrier material and a short edge of said barrier material relative to said ditch.

5. The attachment of claim 1 wherein said bottom following shoe depends from said insertion frame and in operation follows along the sides and bottom of a ditch created by said ditcher and serves to guide the barrier material from the barrier roll unwind into the ditch so as to be guided along both sides of the ditch and the short edge of the barrier material does not extend above the ditch and the long edge of the barrier material extends above the ditch a distance greater than the height of the finished erosion barrier.

6. The attachment of claim 1 wherein said ditch following shoe resiliently depends from said insertion frame and said ditch following shoe is positioned under said guide means and said ditch following shoe serves to press the barrier material against the bottom of the ditch.

7. The attachment of claim 1 wherein said first ditch fill disk depends from said insertion frame and is positioned near said bottom following shoe on the side of the ditch wherein the short edge of the barrier material resides so as to, in use, move fill material from the side of the ditch into the ditch so as to partially fill the bottom of the ditch and press the barrier material inserted therein against the sides and bottom of said ditch.

8. The attachment of claim 1 wherein said second ditch fill disk depends from said insertion frame and is positioned near said first ditch fill disk and on the side of the ditch wherein the long edge of the barrier material resides so as to, in use, move fill material from the side of the ditch into the ditch and on top of the barrier material so as to push the long edge of the barrier material to the opposite side of the ditch and to cover the portion of the fill material deposited in the ditch by said first fill disk to form a wrap around the fill material deposited by said first fill disk.

9. A method for making a barrier fence using the apparatus of claim 1 and comprising the steps of:

a) unwinding barrier material from the barrier roll unwind, b) passing the barrier material under and along said bottom following shoe so that the short edge of the barrier material resides along a first side of a ditch created by the ditcher, passes under said bottom following shoe along the bottom of said ditch, passes said bottom following shoe so that said barrier material resides along a second side of said ditch so that the long edge of the barrier material projects outward and upward from said ditch, c) advancing the ditcher so that the first ditch fill disk causes fill material to fall into said ditch and into the barrier material along the sides and bottom of the ditch, d) advancing the ditcher so that the second ditch fill disk causes fill material to push the long edge of the barrier material to the opposite side of the ditch and thereby create a wrap around the fill material in the barrier material deposited by the first ditch fill disk to create an anchoring pouch, e) driving a stake through at least two layers of the anchoring pouch, and f) securing the long edge of the barrier material to the stake.

* * * * *